US007028869B2

(12) United States Patent
De Laforcade

(10) Patent No.: US 7,028,869 B2
(45) Date of Patent: Apr. 18, 2006

(54) DEVICE AND METHOD FOR PACKAGING AT LEAST ONE PRODUCT AND METHOD FOR MIXING AT LEAST TWO PRODUCTS

(75) Inventor: Vincent De Laforcade, Rambouillet (FR)

(73) Assignee: L'Oreal S.A., Paris (FR)

( * ) Notice: Subject to any disclaimer, the term of this patent is extended or adjusted under 35 U.S.C. 154(b) by 248 days.

(21) Appl. No.: 10/617,692

(22) Filed: Jul. 14, 2003

(65) Prior Publication Data

US 2004/0060831 A1 Apr. 1, 2004

Related U.S. Application Data

(60) Provisional application No. 60/397,659, filed on Jul. 23, 2002.

(30) Foreign Application Priority Data

Jul. 15, 2002 (FR) ..... 02 08915
Nov. 26, 2002 (FR) ..... 02 14830

(51) Int. Cl.
*B05B 11/06* (2006.01)

(52) U.S. Cl. ..... 222/633; 222/129; 222/209; 222/145.1; 206/219; 215/DIG. 8

(58) Field of Classification Search ..... 222/630–633, 222/207–215, 94, 145.1, 145.5, 145.6, 129, 222/541.6; 206/219–221, 568; 215/DIG. 8
See application file for complete search history.

(56) References Cited

U.S. PATENT DOCUMENTS 3,198,194 A * 8/1965 Wilburn ..... 206/221

(Continued)

FOREIGN PATENT DOCUMENTS

EP 0 606 429 B1 7/1994

(Continued)

OTHER PUBLICATIONS

English-language Abstract of JP-09023857, published Jan. 18, 1997 (1 page).

(Continued)

*Primary Examiner*—Frederick C. Nicolas
(74) *Attorney, Agent, or Firm*—Finnegan, Henderson, Farabow, Garrett & Dunner, LLP

(57) ABSTRACT

A device for packaging at least one product may include at least one compartment for containing at least one product, at least one passage, and at least one component. The at least one component may be at least partially elastically compressible and disposed in the at least one passage. The device may further include a pressurization portion configured to generate, in response to a manual activation, a fluid pressurization applied to the at least one component. The device may be configured so that the fluid pressurization is applied to the at least one component in at least two opposing directions so as to cause a reduction in volume of the at least one component and at least partial opening of the passage.

57 Claims, 7 Drawing Sheets

U.S. PATENT DOCUMENTS

| | | | | |
|---|---|---|---|---|
| 3,468,458 | A | 9/1969 | Leigh | |
| 3,674,028 | A * | 7/1972 | Ogle | 206/221 |
| 3,796,303 | A * | 3/1974 | Allet-Coche | 206/220 |
| 4,234,083 | A | 11/1980 | Cohen | |
| 4,331,233 | A * | 5/1982 | Braymer, Jr. | 206/221 |
| 6,189,688 | B1 * | 2/2001 | Aneas | 206/219 |
| 6,758,374 | B1 * | 7/2004 | Albisetti | 222/209 |
| 6,866,039 | B1 * | 3/2005 | Wright et al. | 128/203.15 |
| 2002/0066750 | A1 | 6/2002 | Albisetti | |

FOREIGN PATENT DOCUMENTS

| | | |
|---|---|---|
| FR | 2 115 572 | 7/1972 |
| FR | 2 708 913 | 2/1995 |
| JP | A S63-317468 | 12/1991 |
| JP | A2001-114326 | 4/2001 |
| WO | WO 03/53812 | 7/2003 |

OTHER PUBLICATIONS

English-language translation of First Office Action issued by the Chinese Patent Office on Jul. 23, 2004, in counterpart application (5 pages).

Patent Abstracts of Japan, vol. 1999, No. 03, Mar. 31, 1999 & JP 10 324374 A.

English language Derwent Abstract of FR 2 708 913, Feb. 17, 1995.

* cited by examiner

Fig. 5C
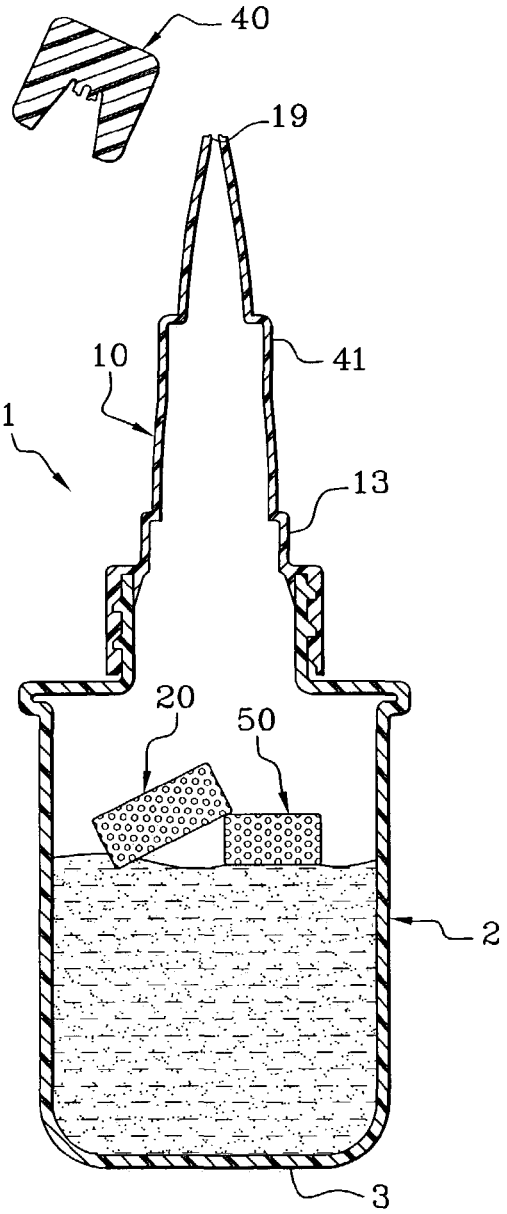
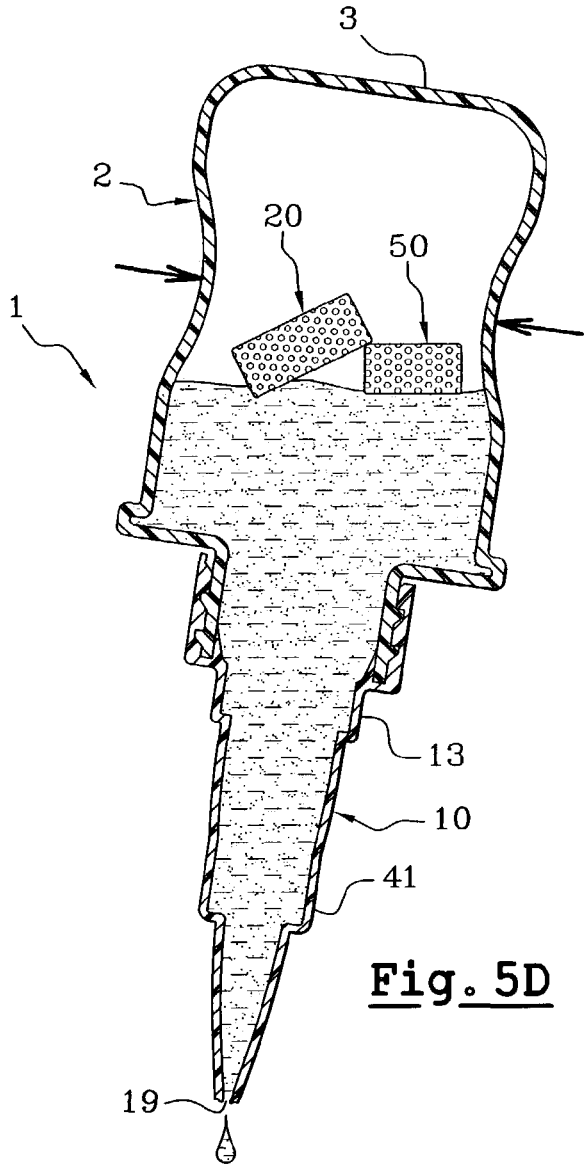
Fig. 5D

DEVICE AND METHOD FOR PACKAGING AT LEAST ONE PRODUCT AND METHOD FOR MIXING AT LEAST TWO PRODUCTS

This application claims the benefit of priority under 35 U.S.C. § 119(e) of U.S. provisional application Ser. No. 60/397,659, filed Jul. 23, 2002.

The present invention relates to a device for packaging at least one product, such as a cosmetic product. For example, the invention relates to a device for the extemporaneous mixing of at least two products in order to create a composition, for example, a cosmetic composition for use in the field hair coloring.

Other uses for the invention may, however, be envisioned. For example, the device may include a receptacle containing a product such that the product may be distributed in response to a pressure applied to the wall(s) of the receptacle and/or by a manually operated pump associated with the device. With devices of this type, it may be desirable, for example, with certain products having a strong propensity for drying and/or oxidation upon contact with the air, to ensure that there is a substantially sealed closure of a distribution hole of the device so that any residual product located upstream of the distribution hole remains substantially sealed from the air.

In some areas, for example, such as in the field of hair coloring, the preparation of many coloring compositions may involve the extemporaneous mixing of, for example, two or more products (e.g., a colorant, an oxidant, and/or possibly a fragrance) which, for reasons, for example, of stability, must be kept separate from each other until the moment of use of the coloring composition. For example, at least one of the products may be in the form of a powder.

In the field of hair coloring, there has been a relatively recent appearance of mixing devices that may allow, in a more or less automatic manner, the separate packaging of two products and their extemporaneous mixing to form a coloring composition at its time of use. For example, a device of this type is described in French patent application FR-A-2 708 913. Such systems are costly, however, and very often they may be relatively complicated to produce. Furthermore, it may often be difficult to achieve a sufficient seal between the two compartments that contain each of the products. In addition, it may sometimes be difficult to find materials that are compatible with the compositions to be packaged due to, for example, the very aggressive nature of at least some of those compositions.

There are also systems that function in a-more "manual" manner in which each of the products to be mixed is packaged in its own packaging, for example, in the form of a tube or sachet. In order to perform the mixing, the user pours the contents of one package into the other, or the contents of the two packages into a third receptacle, within which the mixing is may be carried out.

All of these operations may be tedious, and there may be a high risk of the user becoming soiled during the handling of the products. There may also be a high risk of the user failing to apply the correct dosage and/or being tempted to use the quantities necessary for a single application for two or more applications. Such incorrect dosages may result in the hair coloring not being in accordance with expectations.

European patent application no. 0 606 429 describes a mixing system having two chambers isolated from each other by a first rubber piston which, in response to pressure applied by a second piston, may be pushed from a first position in which it isolates the two products to a second position in which it delimits, in combination with an internal surface of a necked area separating the two chambers, a passage able to allow the two products to come into contact with each other. The disadvantages of such a structure may be numerous. For example, the structure may not be well suited for the mixing of non-liquid products, for example, products in the form of powders. Furthermore, it may be limited to the preparation of relatively small volumes, and it may not be very comfortable to use, for example, because of the large amount of pressure that may need to be applied to force the rubber piston to deform and engage in a portion whose transverse cross-section is of a different form from the form of the piston.

One subject of the invention relates to creating a packaging device, for example, for the extemporaneous mixing of at least two products that may solve, completely or partly, at least one of the aforementioned problems. For example, one subject of the invention relates to creating a device that may be relatively simple to use and that may be produced at a relatively low cost. Another subject of the invention relates to creating a device that may substantially limit the risk of misuse, and that, as a result, may substantially reduce the risks of obtaining a product whose properties do not conform to expectations.

Although the present invention may obviate one or more of the above-mentioned needs, it should be understood that some aspects of the invention might not necessarily obviate one or more of those needs.

In the following description, certain aspects and embodiments will become evident. It should be understood that the invention, in its broadest sense, could be practiced without having one or more features of these aspects and embodiments. It should also be understood that these aspects and embodiments are merely exemplary.

In one aspect, as embodied and broadly described herein, the invention includes a device for packaging at least one product. The device may include at least one compartment for containing at least one product, at least one passage, and at least one component. The at least one component may be at least partially elastically compressible and disposed in the at least one passage. The device may include a pressurization portion configured to generate, in response to a manual activation, a fluid pressurization applied to the at least one component. The device may be configured so that the fluid pressurization is applied to the at least one component in at least two opposing directions so as to cause a reduction in volume of the at least one component and at least partial opening of the passage.

The term "fluid" is used in a broad sense, and refers to, but is not limited to mean "hydraulic" (e.g., in a substantially liquid state) and/or "pneumatic" (e.g., air or other substance in a substantially gaseous state).

According to another aspect, the passage may be situated upstream of a discharge hole of the device, and may, other than during product distribution phases, be kept closed in a substantially sealed manner, for example, in order to substantially prevent any residual product located upstream of the discharge hole from drying and/or oxidizing upon contact with the air.

According to yet another aspect, the at least one compartment may include a first compartment and a second compartment, wherein the first compartment is configured to contain a first product, and the second compartment is configured to contain a second product and to be disposed at least partially on top of the first compartment, wherein the at least one component forms a separating component configured to move from a first position in which the first separating component substantially isolates the first product from the second product, to a second position in which contact of the first product and the second product with one another is enabled. The device may be configured so that movement of the separating component from the first position to the second position results, in response to a balancing of pressures between the first compartment and the second compartment, from a reduction in volume of the first separating component in response to the pressurization generated inside at least one of the first compartment and the second compartment. For example, the separating component may be configured such that it substantially ensures the physical separation of the two products. On the other hand, it may allow a substantial balancing of the pressures to take place.

In, practice, the lower the level of the seal that may be required to substantially ensure the physical separation of the two products, the lower the pressurization that may need to be generated, which may result in a relatively more comfortable operation for the user. For example, at least the product contained in the second compartment may be optionally in the form of a powder resting on the separating component when, for example, the second compartment is disposed above the first compartment. The other product may be, for example, in liquid form. As a result of such an exemplary configuration of the device, the creation of a mixture of products may be extremely simple to achieve. For example, as the fluid pressure is applied in a more or less uniform manner across substantially the entire free surface area of the separating component, a slight pressurization may be sufficient to cause the movement of the separating component from the first position to the second position.

This, however, may not be the case with the types of systems such as those disclosed in European patent application no. EP 0 606 429, in which a separating plug may be forced to move in response to a pressure applied in a unilateral manner. The pressure may be transmitted via the product located between the separating plug and a pressure piston. Such pressure being applied to the, product, which may be sandwiched between the plug and the pressure piston, may be harmful to the product, for example, when the product is in powder form.

According to another aspect, the passage may define an axis, and the reduction in volume of the at least one component may result in at least a reduction in the surface area of at least a portion of the at least one component that is transverse to the axis of the passage. Furthermore, the reduction in volume of the at least one component may result in at least a reduction of at least a portion of the at least one component along its full axial height. For example, in the first position, the separating component may be of sufficiently large diameter (e.g., when the separating component is substantially circular) to remain in position by light clamping, despite the weight of any second product arranged on top of it. In response to the pressure being applied in a multidirectional manner, the separating component may compress in substantially all directions, for example, radially with respect to its axis. As a result of this, it may no longer be lightly clamped in the passage and, under the effect of its weight along with the weight of any second product, it may drop with the latter into the first receptacle. The two products may then come into contact with one another. For example, in exemplary embodiments having a separating component with a substantially circular transverse cross-section, a reduction in diameter of a few tenths of a millimeter may be sufficient to obtain this result.

According to some exemplary embodiments, as the pressure that is applied to the separating component is more or less uniform across substantially its entire exterior surface, a slight reduction may also be noticed in the axial height of the separating component. In such a case, the reduction in volume may be multidirectional when, for example, the separating component is made from a material that is configured to retract under the effect of pressurization and thereby reduce in volume.

According to still another aspect, the device may be configured such that the movement of the separating component from the first position to the second position results from a pressurization generated in the first compartment when the first compartment is located below the second compartment, and wherein the device may be configured such that the level of the first product in the first compartment is such that the passage of the separating component from the first position to the second position takes place before the first product comes into contact with the separating component.

According to another aspect, the pressure being applied to the separating component may be pneumatic.

In still another aspect, the pressurization may be applied to one compartment that may be disposed on top of another compartment. In exemplary embodiments in which the product contained in the one compartment on top of the other compartment is a liquid having a density that is greater than the density of the material forming the separating component, then, in response to the pressurization, the separating component may reduce in volume until it is no longer held in a position where it substantially isolates the two compartments from each other. It may then rise to the surface of the liquid in the one compartment as the liquid mixes with the product contained in the other compartment. For example, in such an exemplary embodiment, the pressure that is applied to the separating component may be a hydraulic pressure.

According to another aspect, the at least one component may include an external surface area, and at least a portion of the external surface area may be substantially impermeable. The term "impermeable" is used in a broad sense, and refers to, but is not limited to mean impermeable to the pressurization fluid, for example, to air.

In still another aspect, the at least one component may at least partially include an alveolar material having closed cells. For example, the alveolar material may include at least one material selected from polyethylenes, polyesters, and polyurethane foams.

In yet another aspect, the separating component may be configured to float to the surface of a mixture of the first product and second product. For example, in a second position, the separating component may float to the surface of the mixture, so that, for example, the separating component does not substantially disturb distribution of the mixture.

According to a further aspect, the passage may define an axis, and the passage may be located between the first compartment and the second compartment, wherein the separating component may be disposed inside the passage and may be, prior to the pressurization, held in the first position via partial compression in at least one direction transverse to the axis of the passage and also in contact with an internal surface of the passage. Despite any slight compression of the separating component, the air may pass between the lateral surface of the separating component and the internal surface of the passage, thereby allowing substantial balancing of the pressures to be achieved. For example, when the pressures have been substantially balanced, the pressure of the first compartment and that of the second compartment may be more or less identical and each may have an excess pressure in relation to the initial pressure of these compartments. The separating component arranged between these two compartments may, as a result, be compressed in at least two substantially opposite directions. For example, the pressure may be at least applied to two substantially opposing faces of the separating component that is contact with the internal surface of the passage.

According to yet another aspect, the at least one compartment may include at least one wall that may be elastically deformable and that may be configured to generate the pressurization in response to a pressure applied at least one of laterally and axially to the at least one wall. For example, according to one aspect, at least a portion of the at least one compartment may include a bellows, and the pressure applied may be, for example, axial.

According to still a further aspect, the compartment in which the pressurization is generated may be substantially defined by a receptacle having elastically compressible walls, and the pressure may be applied, for example, transverse to the axis.

In yet another aspect, the first compartment may include a first receptacle and the second compartment may include a second receptacle, wherein the second receptacle may be configured to be mounted to the first receptacle via at least one of threading and snap-fastening.

In still another aspect, the second receptacle may include an opening substantially isolated from the second product by the separating component when the separating component is located in the first position. For example, the opening may be substantially closed off in a movable manner via a closure member that may include at least one of a stopper and a screw closure prior to mounting the second receptacle to the first receptacle.

According to a further aspect, a fixing portion may be configured to retain the separating component in a fixed position prior to mounting the second receptacle to the first receptacle. For example, the fixing portion may include a stopper portion, and an axial stop located alongside the separating component and substantially opposite the stopper portion. For example, as the stopper is placed on the second receptacle, it may substantially axially immobilize the separating component, and once the stopper is removed, for example, at the time of positioning the second receptacle on top of the first, the second product may be substantially retained inside the second receptacle by the separating component.

According to a further aspect, the second compartment may include an element forming an application tip configured to mix the products. For example, the second compartment may be configured to communicate with a distribution hole that, prior to mixing the products, may be substantially closed off via a closure component. The closure component may include, for example, a self-breaking element.

In still another aspect, the separating component may be a first separating component, and the device may further include a third compartment configured to be disposed at least partially on top of the second compartment and to contain a third product. The first product, the second product, and the third product may be substantially isolated in pairs, respectively, via the first separating component and a second separating component. The first separating component and the second separating component may each be configured to move from a first position in which they substantially isolate in pairs the first product, the second product, and the third product, to a second position in which the first, second, and third products are brought into contact with each other. The movement of the first separating component and the second separating component from the first position to the second position may result in responsive balancing of the pressures between the first compartment and the second compartment and between the second compartment and the third compartment, caused by a multidirectional reduction in volume of the first separating component and the second separating component in response to a pressurization generated inside at least one of the first compartment, the second compartment, and the third compartment.

The mixing may be carried out, for example, by positioning the device so that the second compartment is on top of the first compartment, and the third compartment on top of the second compartment, and by pressurizing, for example, the first compartment.

The second and third products may be packaged separately from one another in the same receptacle, for example, in an applicator tip.

According to yet another aspect, the device may include a first product contained in the first compartment and a second product contained in the second compartment, wherein the pressurization is generated in one of the first compartment and the second compartment, and wherein the product contained in the other of the first compartment and the second compartment includes a product in powder form.

In still a further aspect, the first compartment may contain a first product including a product in liquid form and the second compartment may contain a second product including a product in powder form. For example, the first product and the second product may include at least one of a cosmetic product and a care product. For example, the first product may include a coloring oxidant and the second product may include a colorant. In another aspect, the device may include a third compartment containing a third product and a second separating component, wherein the second separating component substantially isolates the third product from the first product and the second product prior to pressurization of at least one of the first compartment, the second compartment, and the third compartment. The third product may be, for example, a fragrancing composition that may in the form of a powder.

According to yet another aspect, a device for extemporaneous mixing, of at least two products may include a first compartment containing at least one first product, a second compartment containing at least one second product and being configured to be disposed at least partially on top of the first compartment, and at least one separating component configured to move from a first position in which the separating component substantially isolates the first product from the second product, to a second position in which contact of the first product and the second product with one another is enabled. The device may be configured so that movement of the separating component from the first position to the second position results from a pressurization generated in one of the first compartment and the second compartment. The device may be configured so that the first separating component, when moved from the first position to the second position, is displaced toward the one of the first compartment and the second compartment in which the pressurization is generated.

According to another aspect, the device may be configured so that movement of the separating component from the first position to the second position results, in response to a balancing of pressures between the first compartment and the second compartment, from a reduction in volume of the separating component in response to the pressurization generated inside at least one of the first compartment and the second compartment.

In yet another aspect, the device may include a passage in which the separating component is disposed, wherein the reduction in volume of the separating component results in a reduction in the surface area of at least a portion of the separating component that is transverse to an axis of the passage.

According to a further aspect, a device for packaging at least one product may include at least one compartment configured to contain at least one product and to be associated with a pressurization portion, at least one passage configured to be in flow communication with the compartment and the pressurization portion, and at least one component being at least partially elastically compressible and being disposed in the at least one passage. The device may be configured so that at least one dimension of the component becomes reduced in response to pressurization generated by the pressurization portion so as to enable movement of the component from a first position located in the passage to a second position located remote from the passage and the compartment.

In still another aspect, the at least one compartment may include a first compartment configured to contain a first product and a second compartment configured to contain a second product. The component may form a separating component substantially isolating the first product from the second product when the component is in the first position.

In yet another aspect, the device may include a third compartment configured to be arranged at least partially on top of the first compartment and to contain a third product, wherein the first product, the second product, and the third product are substantially isolated in pairs, respectively, via the component and a second component.

According to still another aspect, the at least one dimension may be in a direction transverse to an axis of the passage.

In still another aspect, a method of mixing at least two products to form a cosmetic composition may include providing a device for packaging at least one product, and generating a pressurization in at least one of a first compartment and a second compartment of the device. For example, the cosmetic composition may be configured to color hair.

The term "providing" is used in a broad sense, and refers to, but is not limited to, making available for use, enabling usage, giving, supplying, obtaining, getting a hold of, acquiring, purchasing, manufacturing, selling, distributing, possessing, making ready for use, and/or placing in a position ready for use.

According to yet another aspect, a method of extemporaneously mixing at least two products may include providing a device for packaging at least one product, and generating a pressurization in at least one of a first compartment and a second compartment.

Aside from the structural and procedural arrangements set forth above, the invention could include a number of other arrangements, such as those explained hereinafter. It is to be understood, that both the foregoing description and the following description are exemplary.

The accompanying drawings are incorporated in and constitute a part of this specification. The drawings illustrate exemplary embodiments of the invention and, together with the description, serve to explain some principles of the invention. In the drawings, FIG. 1 is a schematic exploded perspective view of an embodiment of a device for packaging at least one product;

FIG. 5C is a schematic partial section view of the embodiment of FIG. 4 in a further condition; and FIG. 5D is a schematic partial section view of the embodiment of FIG. 4 in another condition.

Reference will now be made in detail to some possible embodiments of the invention, examples of which are illustrated in the accompanying drawings. Wherever possible, the same reference numbers are used in the drawings and the description to refer to the same or like parts.

Figure 1:
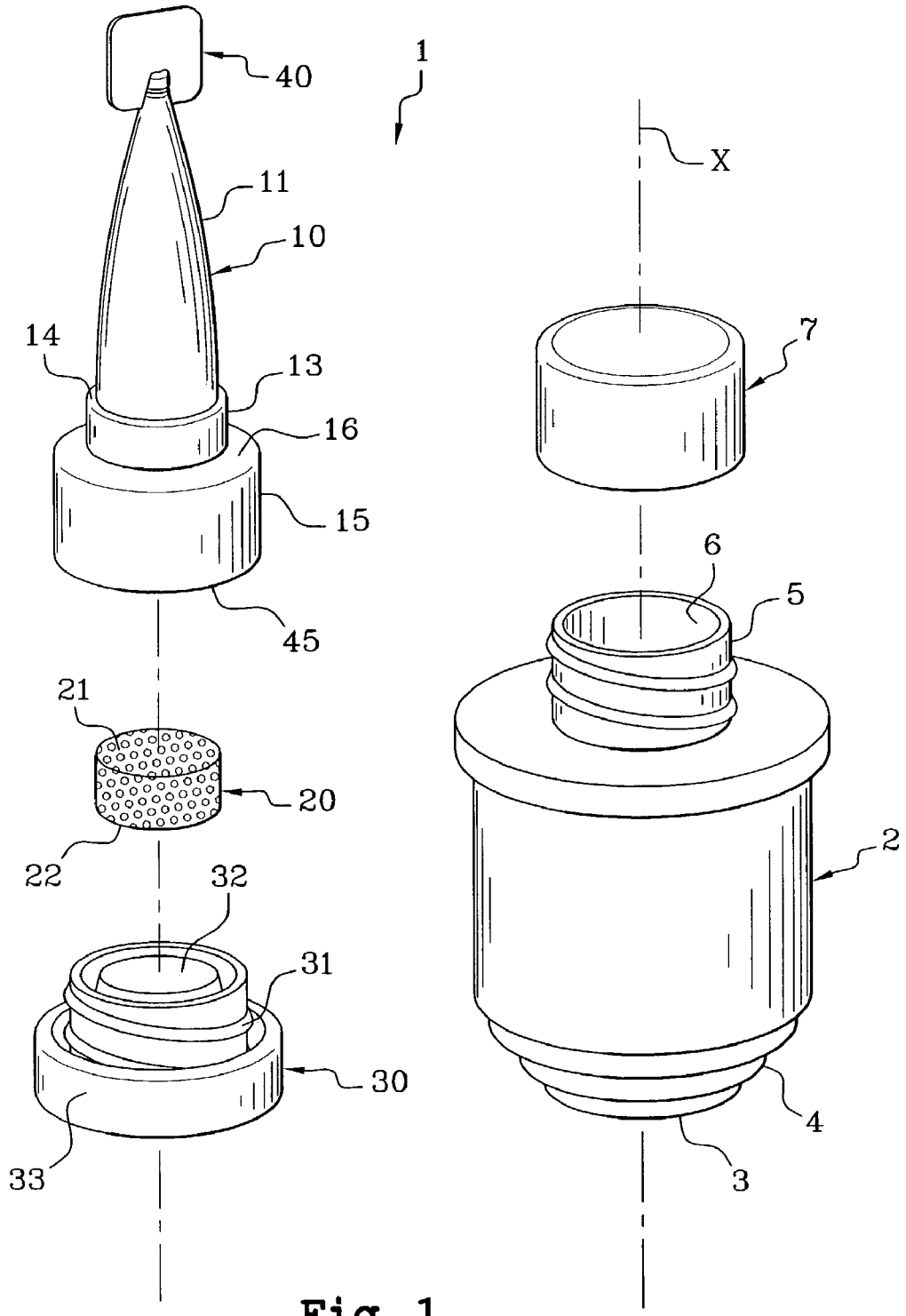
Figure 2:
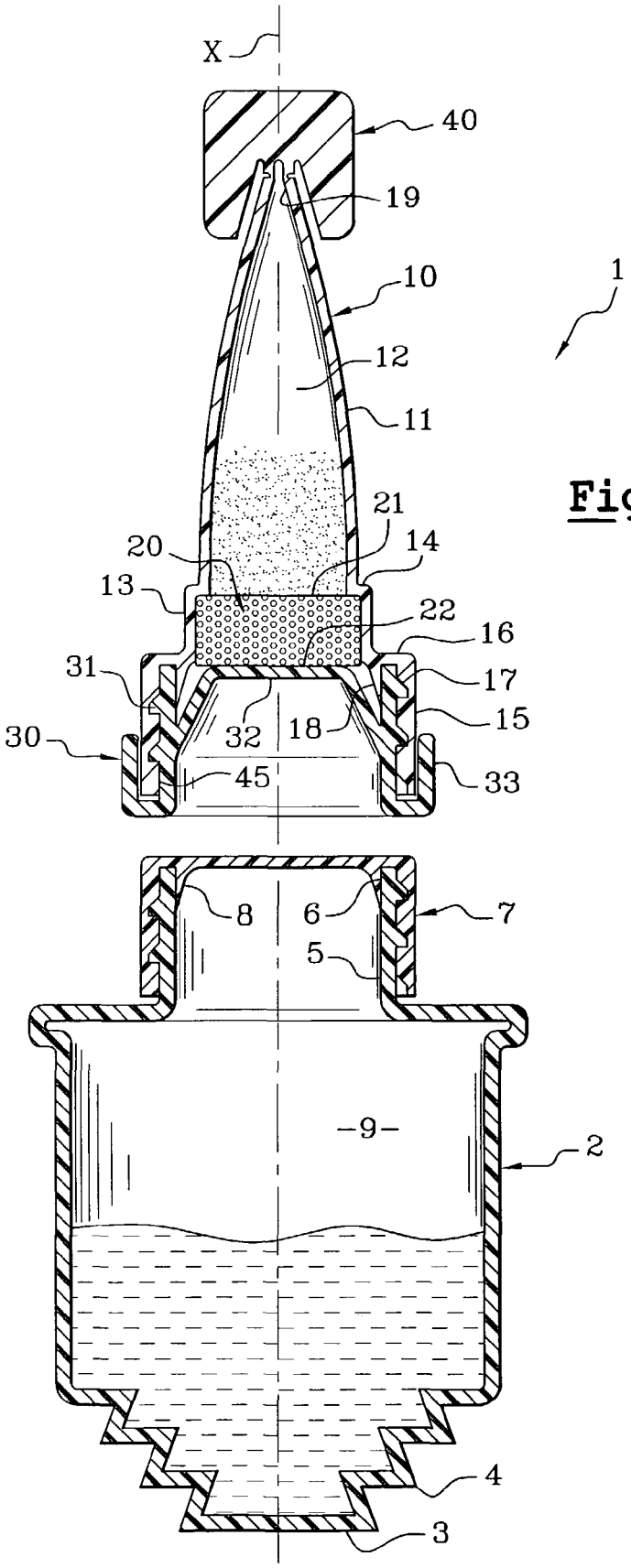
FIG. 2 is a schematic partial section view of the embodiment of FIG. 1.

FIGS. 1 and 2 depict an exemplary embodiment of a device 1 that may include a receptacle 2 having one end that terminates in a base 3. A portion 4 of the body of the receptacle 2 substantially adjacent to the base 3 may be configured in the form of, for example, a bellows. The receptacle 2 may define a housing 9 configured to contain a product, for example, a coloration oxidant in liquid form.

The end of the receptacle 2 substantially opposite to the base 3 may terminate in a neck 5 (e.g., a threaded neck) that substantially defines an opening 6. The receptacle 2 may be formed via, for example, extrusion blow-molding of polyethylene and/or polypropylene.

In a storage and/or transport position of the device 1, the receptacle 2 may be closed by a stopper 7 whose internal surface may include a thread configured to cooperate with a thread of the neck 5 (e.g., when the neck 5 includes a thread). The stopper 7 may include a sealing skirt 8.

The device 1 may include an applicator tip 10, which may include a hollow element having an elongated form, and a portion 11 that may substantially define a transverse cross-section that progressively reduces in the-direction of an opening 19 having, for example, a relatively small cross-section, which may be closed by a closure structure 40, for example, a self-breaking tip.

In the vicinity of an end opposite the closure structure 40, the applicator tip 10 may include a first portion 13 (e.g., a cylindrical portion), which may define a diameter that is greater than the greatest diameter of the portion 11 (e.g., when the portion 11 is substantially cylindrical in cross-section), and which may be separated from the portion 11 by a shoulder 14.

Near the first portion 13 and substantially opposite the portion 11, the applicator tip 10 may form a second portion 15 (e.g., a cylindrical portion) having, for example, an internal diameter that is greater than an internal diameter of the first portion 13 (e.g., when cylindrical). A free edge of the second portion 15 may substantially define an opening 45 for the applicator tip 10, and the second portion 15 may separated from the first portion 13 by a shoulder 16. The internal surface of the second portion 15 may include, for example, a thread 17. Inside the second portion 15, a sealing skirt 18 may be formed that extends axially from the shoulder 16 in the direction of the end of the tip 10 and substantially opposite the closure structure 40.

The applicator tip 10 may be formed, for example, via injection of a rigid thermoplastic material, such as, for example, a polyamide, a polystyrene, a polycarbonate, a polypropylene, an acrylic butadiene styrene (ABS), and/or an acyrlonitrile polystyrene (ANS).

Following the introduction of a product (e.g., a coloring powder) into the housing 12 substantially defined by the portion 11 of the applicator tip 10, a block 20 of, for example, closed cell polyurethane foam may be placed inside the first portion 13. The block 20 may be substantially the same height as the first portion 13. Movement for insertion of the block 20 inside the applicator tip 10 may be substantially limited by the presence of the shoulder 14, against which a surface 21 of the block 20 may abut. In exemplary embodiments having, for example, a cylindrical configuration, the at rest diameter of the block 20 may be slightly greater than an internal diameter of the first portion 13, so that the block 20 may be slightly compressed laterally inside the first portion 13. The degree of compression may be sufficient, for example, to allow the block 20 to retain itself within the first portion 13 despite the weight of any product (e.g., powder) in the portion 11 of the applicator tip 10.

During storage and/or transport, the end of the applicator tip 10 may be closed, for example, via a stopper 30 having an exterior surface that may include, for example, a thread 31 configured to cooperate with a thread 17 of the applicator tip 10 (e.g., in embodiments in which the applicator tip 10 includes a thread). A wall 32 (e.g., a substantially transverse wall) of the stopper 30 may be arranged in order to be substantially in contact with the surface 22 of the block 20 (e.g., a foam block) and substantially opposite the surface 21. An exterior wall 33, which may be, for example, substantially concentric to the exterior surface on which a thread 31 may be formed, may allow for ease of handling of the stopper 30.

FIGS. 3A through 3F depict one exemplary manner in which the exemplary embodiment of the device depicted in FIGS. 1 and 2 may function.

Figure 3C:
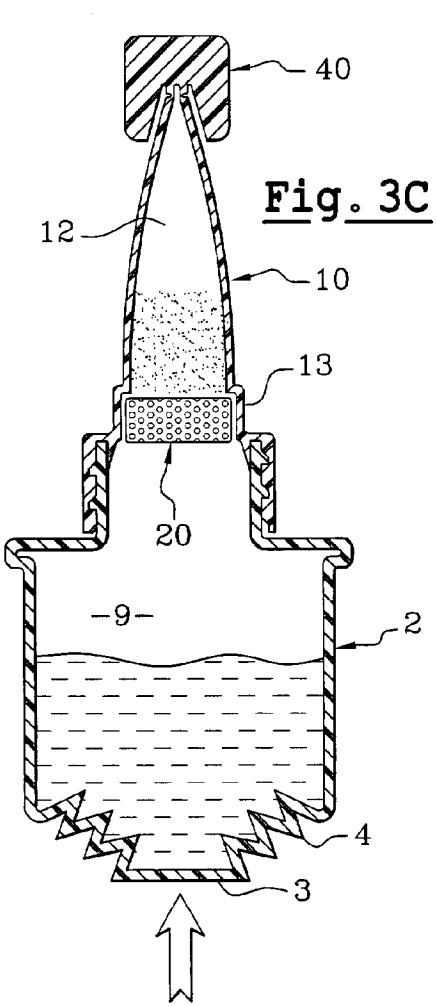
FIG. 3C is a schematic partial section view of the embodiment of FIGS. 1 and 2 in one condition.
Figure 3B:
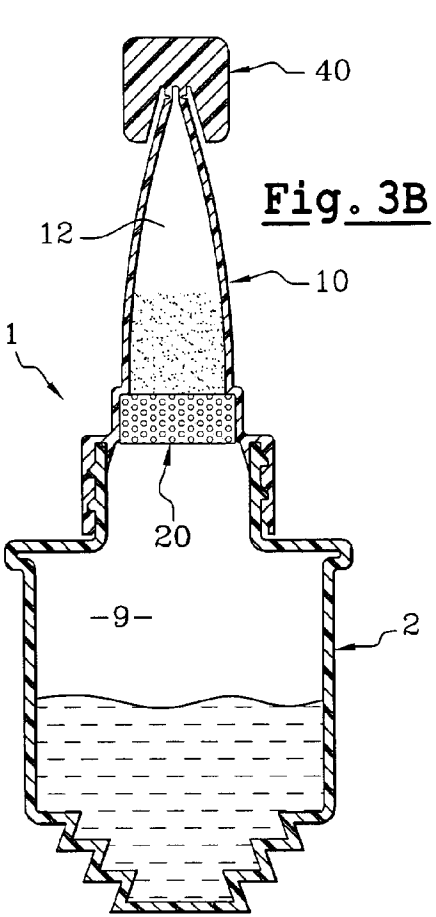
FIG. 3B is a schematic partial section view of the embodiment of FIGS. 1 and 2 in another configuration.
Figure 3A:
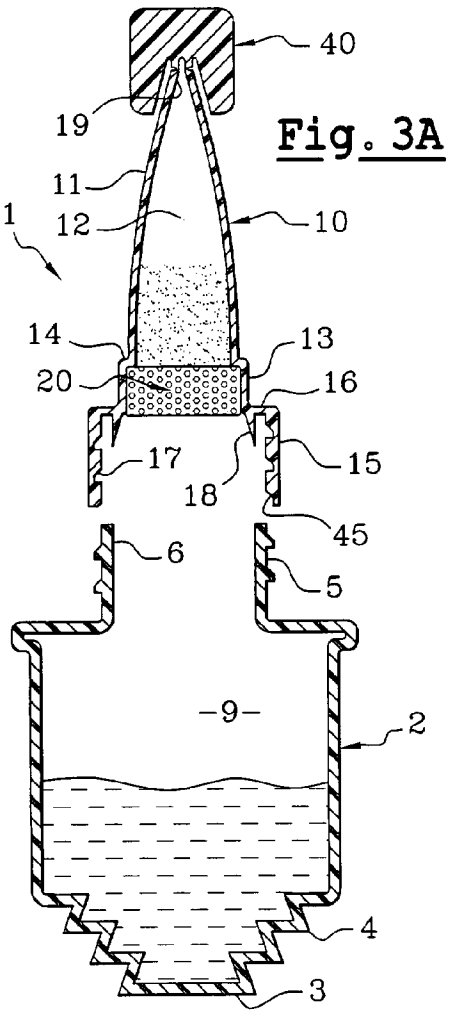
FIG. 3A is a schematic partial section view of the embodiment of FIGS. 1 and 2 in one configuration.

FIG. 3A depicts a configuration of an embodiment in which the stopper 7 has been removed from the receptacle 2, and the stopper 30 has been removed from the applicator tip 10. Even in a substantially upright orientation, the block 20 (e.g., of foam) may be retained, for example, by slight compression inside the first portion 13 (e.g., a cylindrical portion) of the applicator tip 10, despite the weight of the product (e.g., a powder) that, as a result, may be retained within the housing 12.

FIG. 3B depicts an exemplary configuration in which the applicator tip 10 may be mounted onto the receptacle 2 (e.g., via threading).

FIG. 3C depicts an exemplary configuration in which a pressure (e.g., an axial pressure) is applied to the base 3 of the receptacle 2 in order to compress the part 4 (e.g., that may form a bellows). A pressurization may result within the receptacle 2, and, due to an absence of an air seal around the block 20, a balance of pressures may be obtained between the housing 9 and the housing 12. As a result, the pressurization may be applied in a substantially uniform manner to substantially the entire exterior surface of the block 20, which may compress the block 20 in a multidirectional manner. A reduction in an exterior dimension (e.g., diameter) of the block 20 may result that is sufficient for the block 20 to no longer be retained within the first portion 13. The block 20 may then fall under the effect of its own weight along with the weight of any product contained in the housing 12.

Figure 3F:
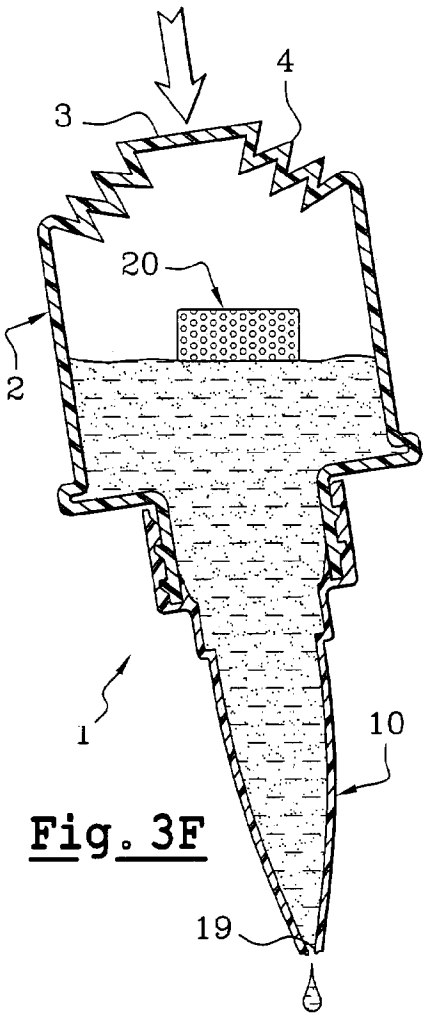
FIG. 3F is a schematic partial section view of the embodiment of FIGS. 1 and 2 in another condition.
Figure 3E:
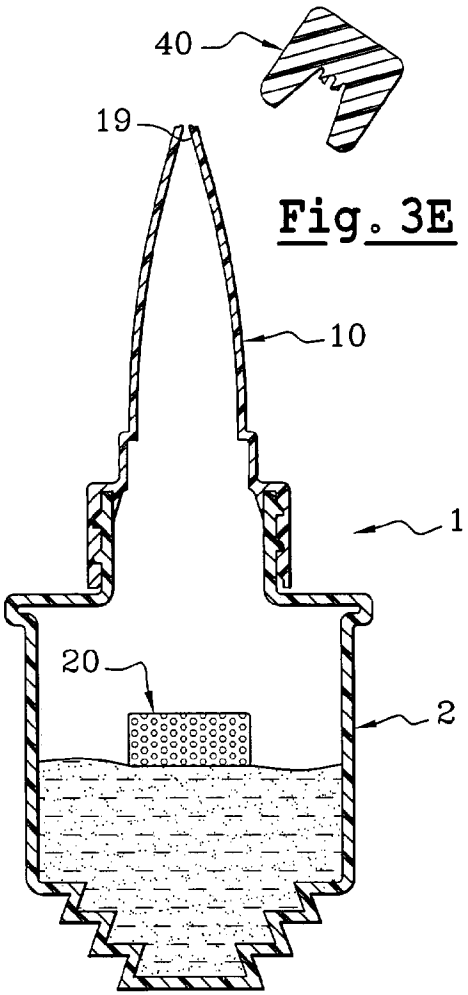
FIG. 3E is a schematic partial section view of the embodiment of FIGS. 1 and 2 in a further condition.
Figure 3D:
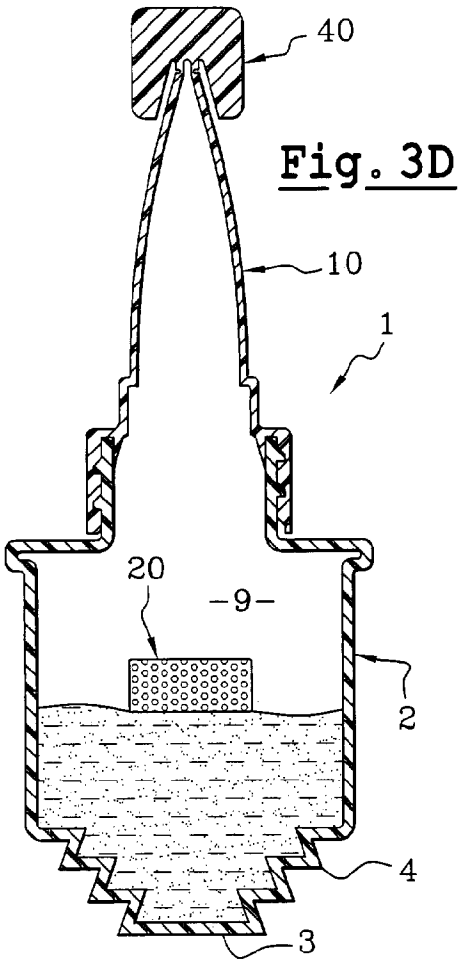
FIG. 3D is a schematic partial section view of the embodiment of FIGS. 1 and 2 in another condition.

FIG. 3D depicts an exemplary embodiment in a condition in which two products are contained inside the receptacle 2, thereby forming a mixture of the two products. The block 20 may be configured, for example, to substantially float to the surface of the mixture. The mixture may then be blended, for example, by agitating the device 1 in a suitable manner.

FIG. 3E depicts an exemplary embodiment of the device in a condition in which the opening 19 of the applicator tip 10 is freed by removing the closure structure 40 (e.g., by breaking off a self-breaking tip).

FIG. 3F depicts an exemplary embodiment of the device in which the mixture is applied in an exemplary manner to the hair under the influence of an exemplary portion 4 in the form of a bellows 4, for example, in order to regulate the discharge of the mixture via the opening 19.

According to some exemplary embodiments of a device that packages, for example, two liquids, it may be advantageous to provide on an internal surface of the shoulder 14, an annular rib (not shown), in order to reduce the risk of formation, prior to the use of the device, of a liquid film between the lateral surface of the block 20 and the internal surface of the first portion 13. It may also be advantageous to perform the mixing with the device 1 in a substantially inverted orientation, as the material forming the block 20 (e.g., a foam block) may have a lower density than the liquid contained in the receptacle 2.

Figure 4:
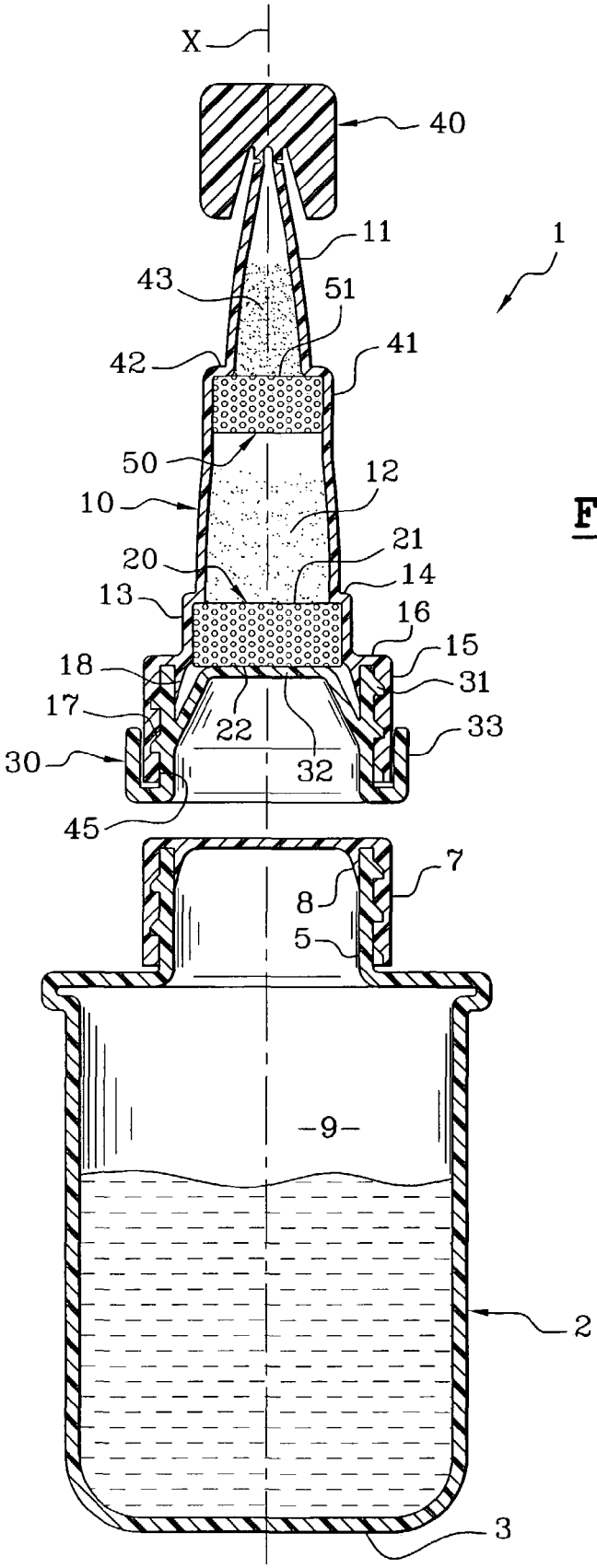
FIG. 4 is a schematic partial section view of another embodiment of a device for packaging at least one product.

FIG. 4 depicts an exemplary embodiment that may include a receptacle 2 having at least one wall that is elastically deformable in response to a pressure applied to the receptacle 2, for example, in a manner substantially perpendicular to the axis X. This exemplary embodiment may also include another portion 41 (e.g., a cylindrical portion) at substantially the mid-point between the first portion 13 (e.g., cylindrical portion) of the applicator tip 10, and the closure structure 40. The portion 41 may define an internal dimension (e.g., an internal diameter) that is slightly less than the internal dimension of the first portion 13. The portion 41 may be separated from a portion of the applicator tip 10 adjacent to the closure element 40 by a shoulder 42, for example, an annular shoulder. Inside the portion 41, a block 50 (e.g., a foam block) substantially similar to the block 20 may be arranged, and a face 51 of the block 50 may abut against the shoulder 42. For example, in the mounted position of the applicator tip 10 on the receptacle 2, the block 20 may separate the compartment 9 defined by the receptacle 2 from the compartment 12 formed in the bottom part of the applicator tip 10. The block 50 may separate the compartment 12 from a compartment 43 formed in the top part of the applicator tip 10. The compartment 9 may contain a product, such as, for example, a coloring oxidant in liquid form, the compartment 12 may contain a product, such as, for example, colorant in powder form, and the compartment 43 may contain a product, such as, for example, a fragrancing agent in powder form.

Other portions of the exemplary embodiment of the device depicted in FIG. 4 may be substantially similar to corresponding portions described with reference the exemplary embodiment depicted in FIGS. 1 and 2, and, as a result, a detailed description of those portions will not be presented here.

FIGS. 5A through 5D depict one exemplary manner in which the exemplary embodiment of the device depicted in FIG. 4 may function.

The exemplary manner of function of the exemplary device depicted in FIG. 4 may initially be substantially similar to the manner of function described for the exemplary embodiment depicted in FIGS. 1 and 2 with reference to FIGS. 3A and 3B.

Figure 5A:
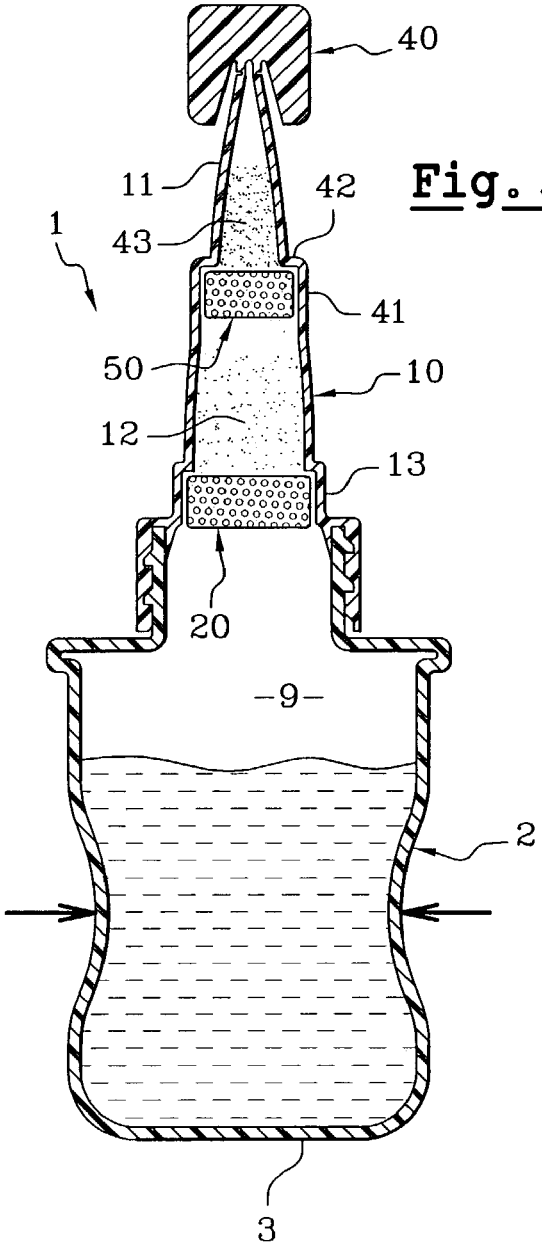
FIG. 5A is a schematic partial section view of the embodiment of FIG. 4 in one condition.

FIG. 5A depicts an exemplary embodiment of the device in which the compartment 9 may be pressurized in response, for example, to a pressure applied (e.g., substantially transversely) on the deformable walls of the receptacle 2. As a result, a pressurization may be generated inside the receptacle 2. Due to the absence of an air seal substantially all around the block 20 and the block 50, any pressure differentials between the housings 9, 12, and 43 may substantially balance in a substantially instantaneous fashion. As a result, the pressurization may be applied in a substantially uniform manner to substantially the entire exterior surface of the blocks 20 and 50, which may compress in a multidirectional manner. A reduction of at least one exterior dimension (e.g., their exterior diameter) may result, which is sufficient for the blocks 20 and 50 to no longer be held inside their respective portions 13 and 41. They may then fall under the effect of their own weight along with the weight of any products (e.g., powders) contained respectively in the housings 12 and 43. For example, the two blocks 20 and 50 may fall in a slightly sequential manner, for example, with the block 20 falling before the block 50.

Figure 5B:
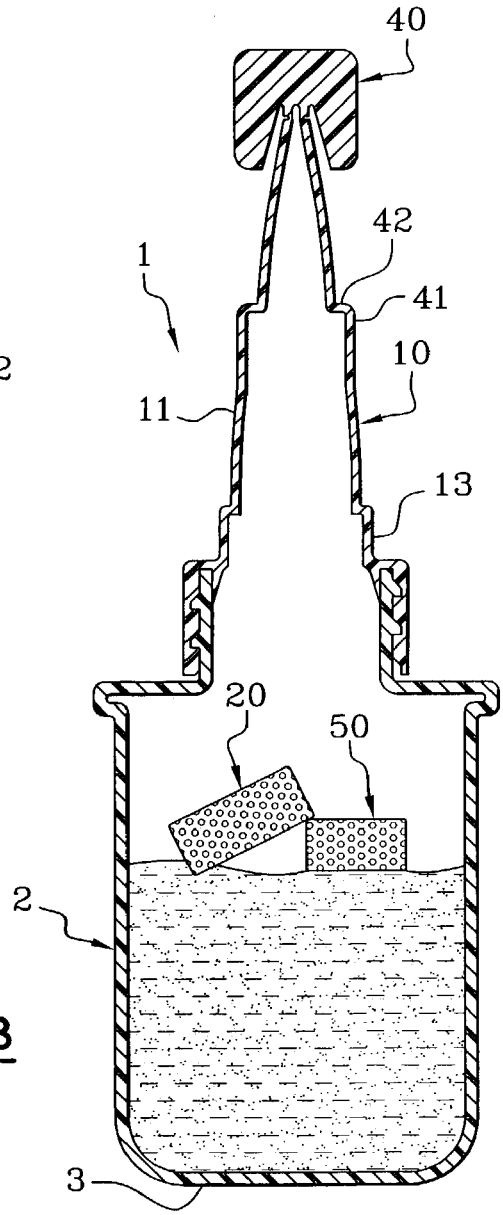
FIG. 5B is a schematic partial section view of the embodiment of FIG. 4 in another condition.

FIG. 5B depicts an exemplary condition in which three products are in a mixture inside the housing 9. The blocks 20 and 50 may float to the surface of the mixture, and the mixture may be blended, for example, by agitating the device 1 in a suitable manner.

FIG. 5C depicts an exemplary condition of the device in which the opening 19 of the applicator tip 10 is released, for example, by removing the closure structure 40 (e.g., by breaking off a self-breaking tip).

FIG. 5D depicts an exemplary condition in which the mixture is applied, for example, to the hair by pressing the receptacle 2 (e.g., a deformable body) in order to regulate discharge of the mixture via the opening 19.

The device according to some exemplary embodiments of the invention may be used to apply cosmetic products and/or care products, such as make-up products, dermatological substances, and/or pharmaceutical compositions used for treating and/or changing the appearance and/or scent of keratinous fibers, such as the hair. However, in its broadest aspects, the present invention could be used to package and/or apply many other substances. In addition, although the embodiments shown in the drawings contain multiple products, alternative embodiments, such as those containing only a single product, are also possible.

Furthermore, sizes of various structural parts and materials used to make the above-mentioned parts are illustrative and exemplary only, and one of ordinary skill in the art would recognize that these sizes, and materials can be changed to produce different effects or desired characteristics.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. A device for packaging at least one product, the device comprising:

at least one compartment for containing at least one product;

at least one passage;

at least one component, the at least one component being at least partially elastically compressible and disposed in the at least one passage; and a pressurization portion configured to generate, in response to a manual activation, a fluid pressurization applied to the at least one component, wherein the device is configured so that the fluid pressurization is applied to the at least one component in at least two opposing directions so as to cause a reduction in volume of the at least one component and at least partial opening of the passage.

2. The device of claim 1, wherein the at least one compartment comprises a first compartment and a second compartment, wherein the first compartment is configured to contain a first product, and the second compartment is configured to contain a second product and to be disposed at least partially on top of the first compartment, wherein the at least one component forms a separating component configured to move from a first position in which the first separating component substantially isolates the first product from the second product, to a second position in which contact of the first product and the second product with one another is enabled; and wherein the device is configured so that movement of the separating component from the first position to the second position results, in response to a balancing of pressures between the first compartment and the second compartment, from a reduction in volume of the first separating component in response to the pressurization generated inside at least one of the first compartment and the second compartment.

3. The device of claim 1, wherein the passage defines an axis, and wherein the reduction in volume of the at least one component results in at least a reduction in the surface area of at least a portion of the at least one component that is transverse to the axis of the passage.

4. The device of claim 2, wherein the device is configured such that the movement of the separating component from the first position to the second position results from a pressurization generated in the first compartment when the first compartment is located below the second compartment, and wherein the device is configured such that the level of the first product in the first compartment is such that the passage of the separating component from the first position to the second position takes place before the first product comes into contact with the separating component.

5. The device of claim 1, wherein the at least one component comprises an external surface area and at least a portion of the external surface area is substantially impermeable.

6. The device of claim 5, wherein the at least one component at least partially comprises an alveolar material having closed cells.

7. The device of claim 6, wherein the alveolar material comprises at least one material selected from polyethylenes, polyesters, and polyurethane foams.

8. The device of claim 2, wherein the separating component is configured to float to the surface of a mixture of the first product and second product.

9. The device of claim 2, wherein the passage defines an axis, and wherein the passage is located between the first compartment and the second compartment, and wherein the separating component is disposed inside the passage and is, prior to the pressurization, held in the first position via partial compression in at least one direction transverse to the axis of the passage and also in contact with an internal surface of the passage.

10. The device of claim 1, wherein the at least one compartment comprises at least one wall that is elastically deformable and that is configured to generate the pressurization in response to a pressure applied at least one of laterally and axially to the at least one wall.

11. The device of claim 1, wherein at least a portion of the at least one compartment comprises a bellows.

12. The device of claim 2, wherein the first compartment comprises a first receptacle and the second compartment comprises a second receptacle, wherein the second receptacle is configured to be mounted to the first receptacle via at least one of threading and snap-fastening.

13. The device of claim 12, wherein the second receptacle comprises an opening substantially isolated from the second product by the separating component when the separating component is located in the first position.

14. The device of claim 13, wherein the opening is substantially closed off in a movable manner via a closure member comprising at least one of a stopper and a screw closure prior to mounting the second receptacle to the first receptacle.

15. The device of claim 13, further comprising a fixing portion configured to retain the separating component in a fixed position prior to mounting the second receptacle to the first receptacle.

16. The device of claim 15, wherein the fixing portion comprises a stopper portion, and an axial stop located alongside the separating component and substantially opposite the stopper portion.

17. The device of claim 2, wherein the second compartment comprises an element forming an application tip configured to mix the products.

18. The device of claim 17, wherein the second compartment is configured to communicate with a distribution hole that, prior to mixing the products, is substantially closed off via a closure component.

19. The device of claim 18, wherein the closure component comprises a self-breaking element.

20. The device of claim 2, wherein the separating component is a first separating component, and wherein the device further comprises a third compartment configured to be disposed at least partially on top of the second compartment and to contain a third product, wherein the first product, the second product, and the third product are substantially isolated in pairs, respectively, via the first separating component and a second separating component, the first separating component and the second separating component each being configured to move from a first position in which they substantially isolate in pairs the first product, the second product, and the third product, to a second position in which the first, second, and third products are brought into contact with each other, and wherein the movement of the first separating component and the second separating component from the first position to the second position results in responsive balancing of the pressures between the first compartment and the second compartment and between the second compartment and the third compartment, caused by a multidirectional reduction in volume of the first separating component and the second separating component in response to a pressurization generated inside at least one of the first compartment, the second compartment, and the third compartment.

21. The device of claim 2, further comprising a first product contained in the first compartment and a second product contained in the second compartment, wherein the pressurization is generated in one of the first compartment and the second compartment, and wherein the product contained in the other of the first compartment and the second compartment comprises a product in powder form.

22. The device of claim 2, wherein the first compartment contains a first product comprising a product in liquid form and the second compartment contains a second product comprising a product in powder form.

23. The device of claim 22, wherein the first product and the second product comprise at least one of a cosmetic product and a care product.

24. The device of claim 22, wherein the first product comprises a coloring oxidant and the second product comprises a colorant.

25. The device of claim 22, further comprising a third compartment containing a third product and a second separating component, wherein the second separating component substantially isolates the third product from the first product and the second product prior to pressurization of at least one of the first compartment, the second compartment, and the third compartment.

26. A method of extemporaneously mixing at least two products, the method comprising:

providing the device of claim 22; and generating a pressurization in at least one of the first compartment and the second compartment.

27. A device for extemporaneous mixing of at least two products, the device comprising:

a first compartment containing at least one first product;

a second compartment containing at least one second product and being configured to be disposed at least partially on top of the first compartment; and at least one separating component configured to move from a first position in which the separating component substantially isolates the first product from the second product, to a second position in which contact of the first product and the second product with one another is enabled, wherein the device is configured so that movement of the separating component from the first position to the second position results from a pressurization generated in one of the first compartment and the second compartment, and wherein the device is configured so that the first separating component, when moved from the first position to the second position, is displaced toward the one of the first compartment and the second compartment in which the pressurization is generated.

28. The device of claim 27, wherein the device is configured so that movement of the separating component from the first position to the second position results, in response to a balancing of pressures between the first compartment and the second compartment, from a reduction in volume of the separating component in response to the pressurization generated inside at least one of the first compartment and the second compartment.

29. The device of claim 27, further comprising a passage in which the separating component is disposed, wherein the reduction in volume of the separating component results in a reduction in the surface area of at least a portion of the separating component that is transverse to an axis of the passage.

30. The device of claim 27, wherein the separating component at least partially comprises an alveolar material having closed cells.

31. The device of claim 27, wherein at least a portion of at least one of the first and second compartments comprises a bellows.

32. The device of claim 27, wherein the first compartment comprises a first receptacle, and the second compartment comprises a second receptacle having an opening that is substantially isolated from the second product by the separating component when the separating component is located in the first position.

33. The device of claim 32, wherein the opening is substantially closed off in a movable manner via a closure member comprising at least one of a stopper and a screw closure.

34. The device of claim 33, further comprising a fixing portion configured to retain the separating component in a fixed position, wherein the fixing portion comprises a stopper portion and an axial stop located alongside the separating component and substantially opposite the stopper portion.

35. The device of claim 27, wherein the second compartment comprises an element forming an application tip configured to mix the products.

36. The device of claim 28, further comprising a third compartment configured to be disposed at least partially on top of the second compartment and to contain a third product, wherein the first product, the second product, and the third product are substantially isolated in pairs, respectively, via the separating component and a second separating component.

37. The device of claim 27, further comprising a first product contained in the first compartment and a second product contained in the second compartment, wherein the pressurization is generated in one of the first compartment and the second compartment, and wherein the product contained in the other of the first compartment and the second compartment comprises a product in powder form.

38. The device of claim 27, wherein the first compartment contains a first product comprising a product in liquid form and the second compartment contains a second product comprising a product in powder form.

39. The device of claim 38, wherein the first product and the second product comprise at least one of a cosmetic product and a care product.

40. The device of claim 38, wherein the first product comprises a coloring oxidant and the second product comprises a colorant.

41. A method of mixing at least two products to form-a cosmetic composition, the method comprising:

providing the device of claim 39; and generating a pressurization in at least one of the first compartment and the second compartment.

42. The method of claim 41, wherein the cosmetic composition is configured to color hair.

43. A device for packaging at least one product, the device comprising:

at least one compartment configured to contain at least one product and to, be associated with a pressurization portion;

at least one passage configured to be in flow communication with the compartment and the pressurization portion; and at least one component being at least partially elastically compressible and being disposed in the at least one passage, wherein the device is configured so that at least one dimension of the component becomes reduced in response to pressurization generated by the pressurization portion so as to enable movement of the component from a first position located in the passage to a second position located remote from the passage and the compartment.

44. The device of claim 43, wherein the at least one compartment comprises a first compartment configured to contain a first product and a second compartment configured to contain a second product, and wherein the component forms a separating component substantially isolating the first product from the second product when the component is in the first position.

45. The device of claim 43, wherein the reduction in at least one dimension of the component results in a reduction in the surface area of at least a portion of the component that is transverse to an axis of the passage.

46. The device of claim 43, wherein the component at least partially comprises an alveolar material having closed cells.

47. The device of claim 43, further comprising a second compartment, wherein at least a portion of the second compartment comprises a bellows.

48. The device of claim 44, wherein the first compartment comprises a first receptacle and the second compartment comprises a second receptacle, the first receptacle having an opening that is substantially isolated from the second product by the component when the component is located in the first position.

49. The device of claim 48, wherein the opening is substantially closed off in a movable manner via a closure member comprising one of a stopper and a screw closure.

50. The device of claim 49, further comprising a fixing portion configured to retain the component in a fixed position, wherein the fixing portion comprises a stopper portion and an axial stop located alongside the separating component and substantially opposite the stopper portion.

51. The device of claim 44, wherein the first compartment comprises an element forming an application tip configured to mix the products.

52. The device of claim 44, further comprising a third compartment configured to be, arranged at least partially on top of the first compartment and to contain a third product, wherein the first product, the second product, and the third product are substantially isolated in pairs, respectively, via the component and a second component.

53. The device of claim 44, further comprising a first product contained in the first compartment and a second product contained in the second compartment, wherein the pressurization is generated in one of the first compartment and the second compartment, and wherein the product contained in the other of the first compartment and the second compartment comprises a product in powder form.

54. The device of claim 44, wherein the first compartment contains a first product comprising a product in powder form and the second compartment contains a second product comprising a product in liquid form.

55. The device of claim 54, wherein the first product and the second product comprise at least one of cosmetic products and care products.

56. The device of claim 54, wherein the first product comprises a colorant and the second product comprises a coloring oxidant.

57. The device of claim 43, wherein the at least one dimension is in a direction transverse to an axis, of the passage.

* * * * *

UNITED STATES PATENT AND TRADEMARK OFFICE

CERTIFICATE OF CORRECTION

PATENT NO. : 7,028,869 B2
APPLICATION NO. : 10/617692
DATED : April 18, 2006
INVENTOR(S) : Vincent De Laforcade It is certified that error appears in the above-identified patent and that said Letters Patent is hereby corrected as shown below:

In claim 41, column 15, line 56, “form-a” should read --form a--.

In claim 43, column 15, line 66, “to, be” should read --to be--.

In claim 52, column 16, line 55, “be, arranged” should read --be arranged--.

In claim 57, column 18, line 5, “axis, of” should read --axis of--.

Signed and Sealed this

Twenty-fifth Day of July, 2006

JON W. DUDAS
*Director of the United States Patent and Trademark Office*